US007182315B2

(12) United States Patent
Thiery et al.

(10) Patent No.: US 7,182,315 B2
(45) Date of Patent: Feb. 27, 2007

(54) EXHAUST-GAS RECIRCULATION VALVE

(75) Inventors: Christoph Thiery, Ilvesheim (DE); Dirk Schliesche, Billigheim (DE); Bernhard Klipfel, Karlsruhe (DE)

(73) Assignee: Cooper-Standard Automotive (Deutschland) GmbH, Schelklingen (DE)

( * ) Notice: Subject to any disclaimer, the term of this patent is extended or adjusted under 35 U.S.C. 154(b) by 52 days.

(21) Appl. No.: 11/015,342

(22) Filed: Dec. 17, 2004

(65) Prior Publication Data

US 2005/0167629 A1 Aug. 4, 2005

(30) Foreign Application Priority Data

Dec. 19, 2003 (EP) ..... 03029491

(51) Int. Cl.
*F02M 25/00* (2006.01)

(52) U.S. Cl. ..... 251/301

(58) Field of Classification Search ..... 251/301
See application file for complete search history.

(56) References Cited

U.S. PATENT DOCUMENTS 2,883,147 A * 4/1959 Mirza et al. ..... 251/172
3,575,376 A * 4/1971 Arvidson, Jr. ..... 251/31
4,171,689 A 10/1979 Eheim
5,785,034 A 7/1998 Moedinger et al.

FOREIGN PATENT DOCUMENTS

| | | | |
|---|---|---|---|
| DE | 3336879 | A1 | 4/1985 |
| DE | 10106608 | A1 | 8/2002 |
| EP | 1245820 | A1 | 10/2002 |
| EP | 1342907 | A2 | 9/2003 |
| EP | 1462643 | A1 | 9/2004 |
| WO | WO 01/79680 | A1 | 10/2001 |

* cited by examiner

*Primary Examiner*—J. Casimer Jacyna
(74) *Attorney, Agent, or Firm*—Wolf, Greenfield & Sacks, P.C.

(57) ABSTRACT

An exhaust-gas recirculation (EGR) valve (10) comprises a valve opening (14), a valve member (16) that can be moved between a position which closes the valve opening (14) and a position which releases the valve opening (14), and further comprises a flow-guidance member (24), wherein the valve member (16), in the position that releases the valve opening (14), is disposed at least in part behind said flow-guidance member (24), when viewed from the central flow axis.

9 Claims, 3 Drawing Sheets

EXHAUST-GAS RECIRCULATION VALVE

TECHNICAL FIELD

The invention relates to an exhaust-gas recirculation valve.

It is well known in the field of internal combustion engines that, in accordance with the operating state, exhaust gas ought to be recirculated to the fresh-air side so as to thus lower fuel consumption and pollutant emissions.

PRIOR ART

An exhaust-gas recirculation valve that has a pivotable valve-closing member is known from DE 101 06 608 A1; the valve pivot shaft thereof has an off-center position relative to the valve-closing member on a plane that runs parallel to the valve-closing member.

Such a valve pivot shaft arrangement is arrived at from DE 33 36 879 A1 as regards a multipurpose valve. According to the above publication, the valve seat is formed on an annular projection of a securing flange, particularly in order to realize a design that exhibits a low interfering dead space.

DE 27 03 687 A1 describes an exhaust-gas recirculation system in which a tiltable valve is disposed within the intake manifold such as to enable the valve to close or release an exhaust-gas recirculation line that protrudes into the intake manifold.

DE 195 49 107 A1 discloses a similar configuration in which an exhaust-gas recirculation line projects into the intake manifold. The exhaust-gas recirculation line is in an axially closed state at its end and in a radially opened state at one location. A valve member that surrounds the projecting end of the exhaust-gas recirculation line likewise has a radial aperture which can be brought into alignment with the opening of the exhaust-gas recirculation line in order to release the exhaust-gas recirculation line.

Finally, EP 1 342 907 A2 discloses a valve means in which the valve is opened and closed by the counter-rotation of control disks against one another; these control disks comprise openings that can be aligned together, or they can each be located between the openings of the other control disk such that the valve is in a closed state.

DESCRIPTION OF THE INVENTION

The present invention is based on the object of designing an exhaust-gas recirculation (EGR) valve which avoids flow losses more effectively.

The above object is solved by the exhaust-gas recirculation valve according to claim 1.

The EGR valve according to the invention therefore comprises a valve opening and a valve member. The EGR valve is usually located within an ERG line. In this instance, the valve member, too, is particularly located within the ERG line, and hence generally within the flow of the recirculated exhaust gas. Additionally, this is especially applicable in that position in which the valve member releases the valve opening. In this respect, however, the measures described below are taken, viz. that although the valve member is placed within the EGR line, it is positioned at least in part behind a flow-guidance member.

The valve member can be moved between a position that closes the opening and a position that releases the opening. The valve member can come in all manner of designs. For instance, the valve member may be tiltable, rotatable or pivotable. Furthermore, the valve member may be cupshaped, in which case the member is moved in a translatory manner for the purpose of opening and closing. In accordance with the invention, a flow-guidance member is envisaged. In the position that releases the valve opening, the valve member is disposed at least in part, when viewed from a central flow axis, behind the flow-guidance member. This flow-guidance member essentially serves to conveniently guide the flow of exhaust gas past the valve member in its open position and as far as possible to do so without flow losses through the valve opening or at most with minimum flow losses therethrough. To this extent, the flow-guidance member is placed preferably on the "hot" side of the EGR valve since the exhaust-gas flow from this side meets the valve, where it can be particularly conveniently guided or passed through the flow-guidance member. In the present context, the "hot" side means that the EGR valve according to the invention can be positioned particularly close to the exhaust manifold and/or in front of an exhaust-gas cooler. The measures described above and as follows make the EGR valve according to the invention suitable for such a configuration. It must be emphasized, however, that the valve does not absolutely have to be placed on this side, but may be located just as readily in other areas and can, furthermore, be especially disposed in such a way that the flow-guidance member is located downstream of the valve member. This configuration would have the advantage, for example, that the preferably tiltable valve member could be mounted on the sealed side and thus suffer less from dirt accumulation caused by the amassing exhaust gas.

The fact that the valve member in its position that releases the opening is placed at least in part behind the flow-guidance member entails several advantages. The first thing to be said about this configuration is that it is identifiable when viewed from a central flow axis. In other words, what is viewed is that position in the flow at which the valve member is located in the opened state. In accordance with the invention, the valve member is at least partly invisible at this point in the flow, i.e. in the flow direction at the location of the opened valve member, because it is "covered" at least in part by the flow-guidance member. This "covered" position behind the flow-guidance member prevents the opened valve member from extensively influencing the flow. As a result, it is possible to reduce flow losses. Moreover, the valve member is conveniently shielded, as far as the heat load is concerned. To an extent, the flow-guidance member insulates the valve member thermally from the hot flow of exhaust gas, thus enabling the configuration according to the invention to open the valve member toward the "hot" side. In this opened position, the valve member is in fact prevented from thermally overloading by having the flow-guidance member cover it.

Opening the valve member in the direction of the hot side of an EGR valve has the advantage that the amassing exhaust-gas pressure presses the valve member into the closed state. That is why the closed state does not require any complicated measures in order to ensure closure of the valve opening. On the contrary, the amassing exhaust-gas pressure itself presses the valve into the closed position. Opening the valve member against this amassing gas pressure can be ensured by taking comparatively simple measures. Opening the valve against the amassing exhaust-gas pressure is in any case easier to realize than if the maintenance of the closed state against the gas pressure had to be ensured. It should be mentioned in conjunction with the opening of the EGR valve according to the invention that this opening process can be achieved, for example, in accordance with European patent application filed by the Applicant at the European Patent Office on Oct. 24, 2003 (application number 03 024 509) and European patent application filed at the EPO on Mar. 25, 2003 (application number 03 006 733). Even with respect to the arrangement of the rotary shaft in the event of a rotatable valve, the valve member can, furthermore, be designed such as is described in EP 1 245 820 A1. The aforementioned applications were made part of the present application with regard to the named features. Finally, it should be stated that even the use of a flow-guidance member in an EGR valve alone is regarded as an innovation which offers its own advantages over the hitherto known configurations. In this regard, an EGR valve that has a flow-guidance member, but not necessarily the other aforementioned features, though possibly exhibiting any combination of the preferred features explained above and below, is to be considered to constitute the subject matter of the present application.

Unlike the subject matter of EP 1 342 907 A2, it must be stressed that, in the case of this known EGR valve, one of the control disks is indeed arranged behind the other control disk. Nevertheless, the "front" control disk forms part of the valve and, when examined in this light, comprises valve openings, with the result that this control disk cannot be regarded as a flow-guidance member. In contrast, the flow-guidance member of the EGR valve according to the invention comprises a certain extension in the direction of flow, which causes the flow to be reliably guided, and the opened valve member can be disposed "behind" the flow-control member, whereas, in the closed state, the valve member is moved in front of or next to the flow-guidance member. As a result, the latter does not have any detrimental impact on the flow.

Preferred extensions of the EGR valve according to the invention are described in the further claims.

The valve member can be arranged, relative to the flow, in such a manner that the opening is effected against the direction of flow. This arrangement is beneficial inasmuch as it is unnecessary to resort to special mechanisms in order to ensure that the valve member remains closed against the amassing gas pressure. On the contrary, the amassing gas itself presses the valve member into the closed position. As mentioned, this advantageous configuration is made possible by the flow-guidance member according to the invention in that in its opened position, the valve member can be protected from the hot gases and can, at least in part, be thermally insulated.

A pipe section is currently preferred for the flow-guidance member. The pipe may have a circular cross-section and be adapted, in this respect, to the cross-section of the EGR line. A flow-guidance member shaped in this way makes it possible to achieve particularly good flow guidance. Other pipe cross-sections are, however, possible as well. Possible examples include an oval, rectangular or polygonal cross-section.

Additionally, it has proved convenient for the flow-guidance member, across the cross-section of the valve opening or of the EGR line, to be angled at least at one end. For instance, a pipe section can be cut off in an angled or inclined fashion at least at one end relative to the central flow axis. This approach takes effective advantage of the aforementioned beneficial covering function of the flow-guidance member without impeding the valve member's required movements.

A tiltable, rotatable or pivotable design is currently preferred for the valve member. This type of movement allows the valve member to assume the "protected" position behind the flow-guidance member with particular ease. It should be emphasized, however, that this advantage can be gained when the valve member undergoes translatory movement, too.

It proves beneficial for the rotary shaft of a tiltable valve member to be positioned outside the plane of the valve opening. This offers the advantage that the valve member is continuous across its circumference and is not interrupted by portions of the rotary shaft, thus producing particularly reliable sealing. Furthermore, the rotary shaft's above-described configuration can conveniently bring about the fact that the valve member can be moved into the protected position behind the flow-guidance member.

This is favored by that preferred embodiment in which the rotary shaft has an off-center position relative to the central flow axis. As a result, the movements of the valve member can be adjusted relative to the valve seat such that both reliable closure of the valve opening is achieved and the valve member is released smoothly from the valve opening.

A further preference is for the valve member to have a largely conical (tapered) or spherical design at that side facing toward the valve opening. This permits an especially good interaction with the valve seat that borders the valve opening.

Finally, it has turned out to be advantageous for the course of flow if the region of the EGR valve includes a valve-member receiving chamber in the valve member's opened position; in terms of its shape, this receiving chamber is adapted to the shape of the valve member itself and to its movement from the closed position into the opened position.

This offers the advantage that in its opened position, the valve member is moved completely out of the flow, thus impairing the flow to an extremely low extent.

BRIEF DESCRIPTION OF THE DRAWINGS

An embodiment example of the invention will now be explained in further detail on the basis of the attached drawings.

DETAILED DESCRIPTION OF A PREFERRED EMBODIMENT

Figure 1:
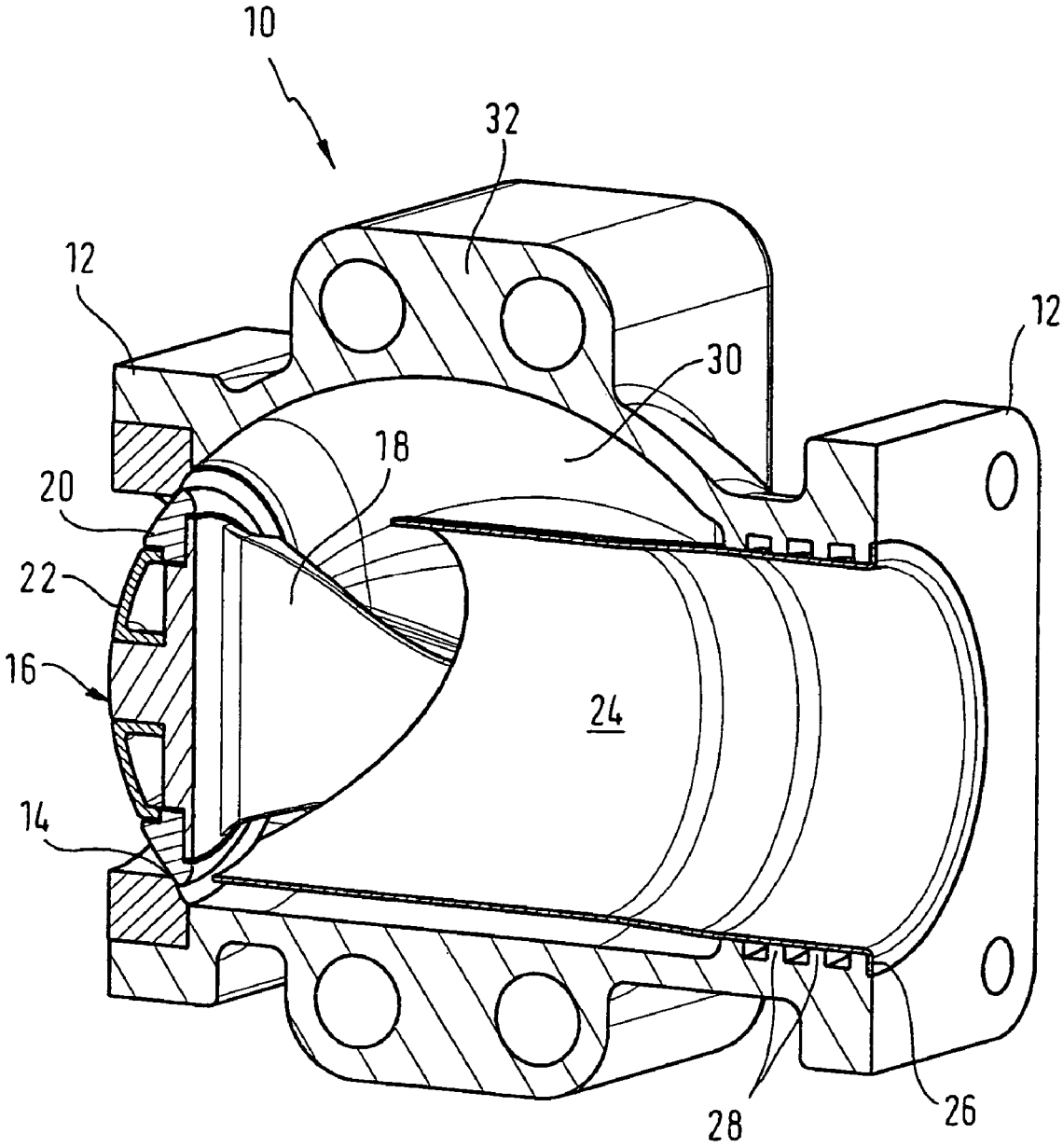
FIG. 1 depicts a perspective sectional view of the exhaust-gas recirculation valve according to the invention in a closed position.

The EGR valve 10 shown in FIG. 1 is located within a portion of the EGR line and, for this purpose, the valve is provided at its respective ends with flanges 12 which permit installation into the EGR line. The valve opening 14 is, for example, circular and is defined by a valve seat. Cooperating with the valve seat is a valve member 16 which, corresponding to the valve seat, is roughly circular. In this particular instance, the valve member 16 is spherical in design at that side which faces the valve opening. In the embodiment example depicted, the valve member further comprises three portions. A first portion 18 forms a base body to which an annular member 20 is attached for the actual interaction with the valve seat. On the side facing the valve opening is a third member 22 that completes the spherical configuration on this side.

The base body 18 has a largely circular design in the region of the valve opening. Two portions that can be designated as arms are integrally connected to this region and ensure connection to the respective rotary shaft; because FIG. 1 is a sectional representation, only one of these arms is identifiable therein. Since in the depicted example, the rotary shaft is off-center both outside the plane of the valve opening and relative to the central flow axis, the shaft being downwardly offset in this particular instance, the rotary shaft may be sectional in design. The front portion of the rotary shaft is not identifiable in FIG. 1 owing to the sectional representation, and the "rear" portion according to the depiction in FIG. 1 is covered by the flow-guidance member 24 that will be explained in even more detail below. The arrangement of the rotary shaft is, however, apparent from the other drawings with greater accuracy.

The flow-guidance member 24 is a portion of a pipe that is inserted into the depicted valve configuration from one side, according to the representation of FIG. 1 from the right-hand side, and is supported by a flange 26. In the example depicted, the pipe that forms the flow-guidance member makes contact with the inside of the EGR line only in the region of the right end. Here, too, contact is made only intermittently as a result of the formation of ribs 28. This design, particularly the formation of ribs, is envisaged especially when the EGR valve is located on the "hot" side. The contact that occurs only in the region of the ribs 28 impairs the transfer of heat to the flow-guidance member. If the EGR valve is configured differently, for example on the "cold" side, the manner of attachment can of course be designed differently; in particular, it would be possible to omit the ribs 28.

The flow-guidance member 24 is cut off in an angled manner at that side with which the flow-guidance member faces the valve opening 14. In other words, the flow-guidance member is longer on one side, according to FIG. 1 the lower side than (according to FIG. 1) the upper side. This design helps to satisfy the flow-guidance function, but not to impede the movement of the valve member 16 that is required for opening. As can be more readily identified in the further drawings, this movement occurs as a clockwise rotation. A receiving chamber 30 which is largely spherically concave in design and which is adapted to the movement and shape of the valve member 16 is provided for the opened position of the valve member. In the region of this receiving chamber 30, a region 32 can be identified in the area surrounding the depicted EGR valve 10; this region 32 forms an integral design with the EGR valve and can be used, for example, to cool the valve and to attach the necessary drives, sensors and the like.

Figure 2:
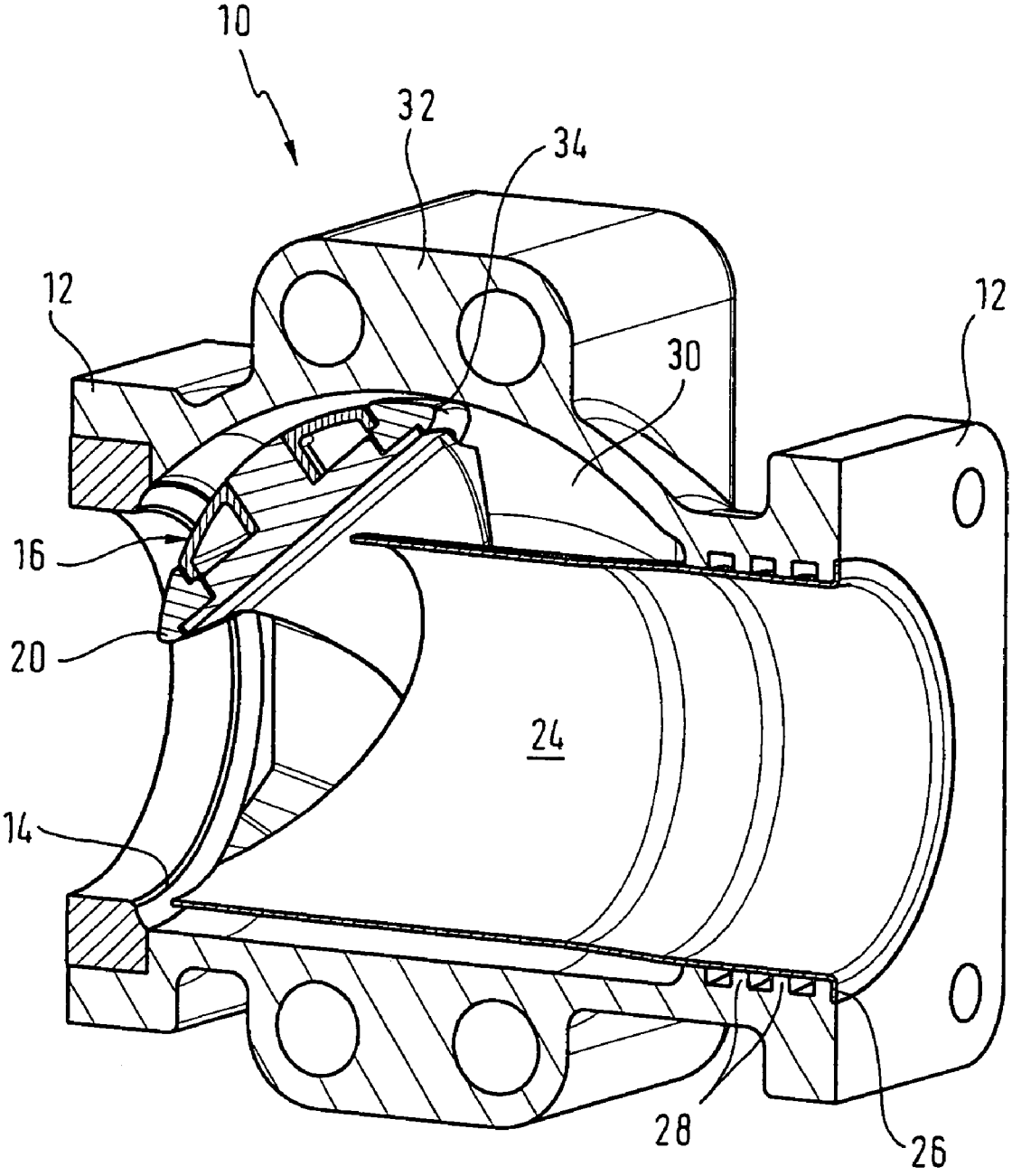
FIG. 2 depicts a perspective sectional view of the exhaust-gas recirculation valve according to the invention during opening of the valve member.

FIG. 2 illustrates the EGR valve shown in FIG. 1 during the opening of the valve member 16. As regards the valve seat 14, FIG. 2 makes it clear that the valve seat is inserted, as a separate member, into the base body of the EGR valve 10 and is angled in a conical or spherical fashion on that side which cooperates with the valve member 16. It can be seen that, due to the arrangement of the rotary shaft outside the plane of the valve member 16, the valve member can be moved at an edge of the depicted portion of the EGR line. The edge 34 of the valve member 16 that is directed toward the rotational movement describes a circular path which is reflected in the shape of the receiving chamber 30. It can be seen that the flow-guidance member 24 permits and does not impede the aforementioned movement of the valve member 16 in that within the region into which the valve member 16 is moved, the angled cut-off makes the flow-guidance member shorter at its one end than on the opposite side.

Figure 3:
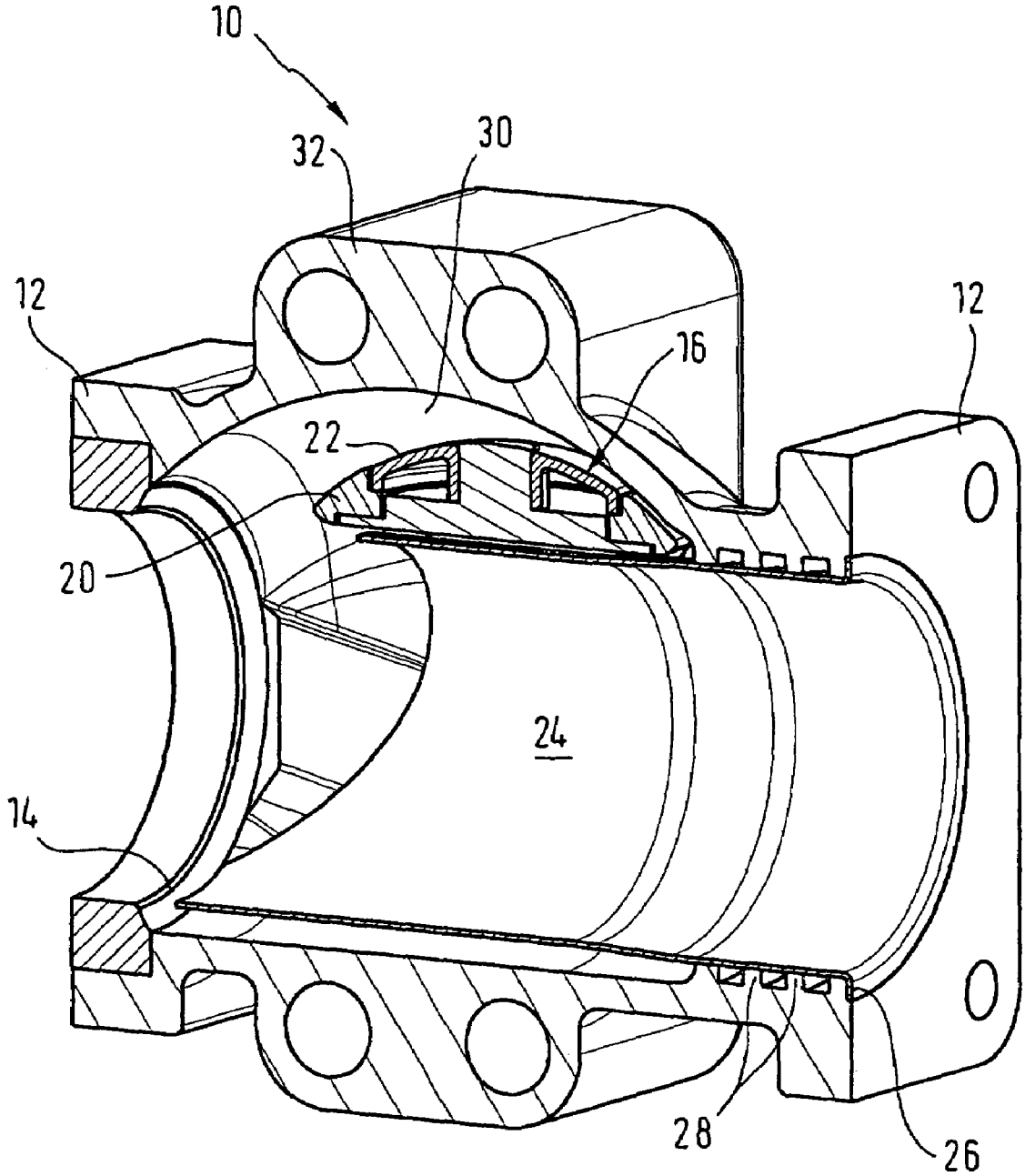
FIG. 3 depicts a perspective sectional view of the exhaust-gas recirculation valve according to the invention in the valve member's opened position.

FIG. 3 depicts the completely opened position of the valve member 16, which position releases the valve opening. The valve member 16 is accommodated within the receiving chamber 30 and is covered largely by the flow-guidance member 24. In other words, if the valve member 16 is viewed from that point in the flow at which the valve member 16 is in the opened position, the valve member is for the most part hidden behind the flow-guidance member 24. In consequence, the flow is virtually not influenced by the opened valve member. Furthermore, the valve member can be opened on the hot side of the EGR line and, in thermal terms, is shielded by the flow-guidance member 24. The plane of the valve member 16 beneficially extends largely parallel to the outer wall of the flow-guidance member 24, thereby utilizing the available structural-design space to particularly good effect.

The invention claimed is:

1. An exhaust-gas recirculation (EGR) valve, comprising a valve opening, a valve member which can be moved between a position that closes said valve opening and a position that releases said valve opening, and further comprising a flow-guidance member, wherein said valve member, in the position that releases said valve opening, is disposed at least in part behind said flow-guidance member, when viewed from the central flow axis, is covered at least in part by said flow-guidance member in the position that releases said valve opening and is, both in a closed and an opened position, located within an EGR line.

2. An EGR valve according to claim 1, wherein said valve member can be disposed relative to the flow such that the opening of said valve member is effected against the direction of flow.

3. An EGR valve according to claim 1, wherein said flow-guidance member is a pipe portion.

4. An EGR valve according to claim 1, wherein said flow-guidance member is cut off at an angle, relative to the central flow axis, at least at one end.

5. An EGR valve according to claim 1, wherein said valve member is tiltable.

6. An EGR valve according to claim 5, wherein a rotary shaft of said valve member is disposed outside the plane of said valve opening.

7. An EGR valve according to claim 5, wherein a rotary shaft of said valve member has an off-center position relative to the central flow axis.

8. An EGR valve according to claim 1, wherein said valve member has a conical or spherical design at that side which faces toward said valve opening.

9. An EGR valve according to claim 1, wherein said EGR valve comprises a receiving chamber which is adapted to the movement of said valve member from the closed position into the release position and which is adapted to the position of said valve member in the release position.

* * * * *

UNITED STATES PATENT AND TRADEMARK OFFICE

CERTIFICATE OF CORRECTION

PATENT NO. : 7,182,315 B2
APPLICATION NO. : 11/015342
DATED : February 27, 2007
INVENTOR(S) : Christoph Thiery et al.

It is certified that error appears in the above-identified patent and that said Letters Patent is hereby corrected as shown below:

Column 6
Claim 8, line 53, add --(tapered)-- after "conical".

Signed and Sealed this

First Day of May, 2007

JON W. DUDAS
*Director of the United States Patent and Trademark Office*